US006119381A

United States Patent [19]

Grocholski

[11] Patent Number: 6,119,381

[45] **Date of Patent: *Sep. 19, 2000**

[54] DISC STORAGE AND DISPLAY DEVICE

[76] Inventor: Adam Grocholski, 6783 SW. 104th St., Miami, Fla. 33156

[ * ] Notice: This patent issued on a continued prosecution application filed under 37 CFR 1.53(d), and is subject to the twenty year patent term provisions of 35 U.S.C. 154(a)(2).

[21] Appl. No.: 08/999,015

[22] Filed: Dec. 29, 1997

Related U.S. Application Data

[60] Provisional application No. 60/033,798, Dec. 31, 1996.

[51] Int. Cl.[7] ..... B42F 5/00

[52] U.S. Cl. ..... 40/405; 40/401; 40/377

[58] Field of Search ..... 40/390, 401, 405, 40/537, 377

[56] References Cited

U.S. PATENT DOCUMENTS

| | | | |
|---|---|---|---|
| 2,231,029 | 2/1941 | Scholfield | 40/401 |
| 4,189,858 | 2/1980 | De Bruin | 40/405 |
| 4,599,815 | 7/1986 | Waldo | 40/377 |
| 4,602,447 | 7/1986 | Feingold | 40/405 |
| 4,643,452 | 2/1987 | Chaung | 283/62 |
| 4,713,901 | 12/1987 | Wells et al. | 40/360 |
| 4,940,142 | 7/1990 | Behrens et al. | 40/405 |
| 5,197,600 | 3/1993 | Garcia et al. . | |
| 5,289,651 | 3/1994 | Byers | 40/537 |
| 5,307,926 | 5/1994 | Mee | 40/377 |
| 5,555,977 | 9/1996 | Oshry et al. | 40/405 |

*Primary Examiner*—Anthony Knight
*Assistant Examiner*—Mark Williams
*Attorney, Agent, or Firm*—Garrison & Associates PS; David L. Garrison; Matthew J. Marquardt

[57] ABSTRACT

A disc storage and display device is provided in which discs, such as CD, CD-ROM, DVD, and floppy diskettes for computers are inserted into transparent envelopes and the envelopes attached to rails on a rotary file structure. The envelopes may be rotated about a mandrel on the storage device to display the contents thereof The envelopes may be readily removed for access to the disc or the disc may be removed from the envelopes while on the mandrel. An articulated protective cover is provided to protect but permit easy access to the disc storage and display device.

7 Claims, 5 Drawing Sheets

DISC STORAGE AND DISPLAY DEVICE

This application claims the benefit of U.S. Provisional Patent Application Ser. No. 60/033,798, entitled Disc Storage and Display Device and filed Dec. 31, 1996.

TECHNICAL FIELD

The present invention relates to the method and apparatus for the filing, storage, display, and retrieval of CD, CD-ROM, and DVD discs, floppy diskettes, or other similar devices; more particularly, it relates to system and structure for filing and maintaining discs in a rotary index file in a secure and protective envelope which is easily manipulated in order to gain access to the disc, and which allows rapid and convenient identification of individual discs.

BACKGROUND OF THE INVENTION

Various forms of rotary and stationary file card systems have been proposed for retaining, selectively displaying, and retrieving printed information, such as names of individuals or companies, addresses, telephone numbers and the like printed in ink on cards or paperboard. Such card file systems are generally provided with specially-shaped cards which may be readily inserted or removed from the system. Such known systems do not provide adequate clearance for or any means for retaining or reviewing discs or other physical objects such as CD-ROM and other computer discs, or anything other than information printed on cards.

At the same time, known systems for storing CD, CD-ROM, DVD, and computer discs do not permit convenient access to large numbers of discs or provide any means to protectively house the discs in a manner which fully displays the discs yet permit easy organization or sorting of the discs and easy removal for use. Moreover, known systems for storing CD-ROM, DVD, and computer discs are ungainly, and incorporate relatively bulky storage means which require inordinate amounts of space for storing discs. For example, a standard hinged plastic box of the type commonly used for the storage of a single CD music disc occupies a volume of approximately 173.4 cubic centimeters, while the disc itself occupies a volume of only approximately 11.3 cubic centimeters. In other words, the box occupies more than 15 times the space occupied by the disc itself In the case of multiple commonly-boxed CD sets, the disparity may be even worse. Using the devices and systems disclosed herein, however, the ratio of storage space to disc space may easily approach unity—with no loss of security or protection for the discs.

Conventional plastic CD, CD-ROM, and DVD storage containers are also difficult to stack, store, and move easily in significant numbers. For example, on an open table one cannot stack the discs upright, in the manner of books on a shelf, without some sort of stop or support at either end to keep the discs from falling. At the same time, flat-stacking of the discs is both difficult, due to the relative slipperyness of the disc cases, and bad for organization: removal of a disc even halfway down a stack all too often results in tipping of the stack, or in the slippage of individual discs/cases from the stack. Moving large numbers of conventionally cased CD discs can also be frustrating and difficult for the same reasons.

On the other hand, another difficulty with known card filing systems is that in order to avoid the need to transfer information from a business card to a specialized index card, it has been proposed to provide attachments for the business cards so the card and attachment can be inserted into a file card index. One form of such attachment comprises a relatively flat member having two openings in one side thereof for mounting in a rotary card file index or rolodex. The flat member has an adhesive thereon covered by a protective strip which is removed to permit a business card to be adhered to the flat member and thus inserted into a file. Such attachments are disclosed in U.S. Pat. Nos. 4,643,452 and 4,713,901. However, these attaching strips have the disadvantage that the making of such attaching strips requires the application of an adhesive and the application of a protective peel-off covering. Further, the use of an adhesive is not generally satisfactory since problems may be encountered in removing an adhered business card from the attaching strip. If such a business card is removed, it may be marked or defaced by the presence of the adhesive. Further, the necessity for removing the protective strips and then adhering the business cards to the adhesive may deter the prompt and accurate filing of business cards in a desired card index file. In addition, the strips themselves, once the adhesive has been exposed and applied to a card, are generally difficult or impossible to reuse effectively. Moreover, the use of adhesive means on CD-ROM discs would be impractical, since the discs must be clean and without substances adhering upon the surface thereof to properly function in the disc reader and since the quality of the adhesive would invariably decline with each application and removal cycle, such that the adhesive strip mounts would have a limited useful life.

DISCLOSURE OF THE INVENTION

It is, therefore, a principal object of the invention to provide novel and improved means to house CD, CD-ROM, and DVD discs and floppy diskettes and to display the discs in a convenient holder. Preferred embodiments of the invention employ rotary configurations somewhat similar to the well known "Rolodex" holders, but substantially enlarged in order to permit rotation of the discs into easy view for selection, and incorporating entirely different elements for holding, viewing, protecting, and selecting the discs. Forms of the well known holders for "Rolodex" cards which provide adequate clearance for the discs may be used, provided they are modified to receive and store discs, as by incorporation of the disc storage and display elements disclosed herein.

It is another object of the present invention to provide a transparent envelope with holder engaging means thereon to snap into the holder and display the disc while providing a secure and protective enclosure for the discs housed therein, which envelope may be easily and readily opened for insertion and removal of the discs.

It is a further object of the present invention to provide a simple, inexpensive, and effective accessory for the filing, protection, and selection of CD, CD-ROM, and DVD discs or computer diskettes in a rotary file index.

It is still another object of the present invention to provide a process for the economical manufacture of a system for the filing and storage of CD, CD-ROM, and DVD discs and computer diskettes.

In one aspect the invention provides a disc storage and display element comprising at least one mounting segment adapted to engage a rotor of a rotary display device, and an envelope attached to the mounting segment. The envelope of this aspect of the invention comprises a longitudinal edge having an opening, the opening and the envelope being adapted to receive and releasably retain a disc. Preferred embodiments of this aspect of the invention comprise transparent, scratch-resistant, protective plastic envelope material so that at least one surface of a disc inside the envelope may be viewed while the disc is in the envelope, such that a particular disc may be identified and selectively removed from the storage device. Mounting segments of preferred embodiments of the invention further comprise at least one open-sided aperture adapted for the removable reception and engagement of a rail on a rotor of a rotary display structure.

In another aspect the invention provides a disc storage and display element comprising at least one mounting segment adapted to engage a rotor of a rotary display structure, and at least one disc support member, the disc support member being attached to the mounting segment and adapted to releasably engage a disc, whereby the disc may be supported and stored by the element. Preferred embodiments of this aspect of the invention comprise at least two disc support members, the disc support members having first and second ends and being depended by the second ends from the mounting segment, the element being adapted to flexibly receive and engage the disc. Preferably such support members depend from each end of an elongated strip embodiment of the mounting segment, such that the elongated strip and disc support members comprise a generally U-shaped configuration. In such embodiments a disc slipped between the legs of the U is elastically gripped by the element, and thereby held in place within it, typically within a set of lateral supports or longitudinal tabs or channels in the support members, and optionally in the mounting segment, the lateral supports or tabs or channels being adapted to receive at least one edge of a substantially circular disc. Additional support for holding the disc within the storage element is provided by adaptation of the support members to elastically engage the disc at points on the disc more distant from the mounting segment than the center point of the disc, so that the support members may apply to the disc forces having components directed through the disc in a circumferential direction, or "downward" or "inward" toward the mounting segment, so that the disc is retained by the storage and display element. As with the previously-described disc storage element aspect of the invention, preferred embodiments of the mounting segment comprise at least one open-sided aperture adapted to engage a mounting rail on the rotor of a disc storage device. Preferred embodiments of this aspect of the invention leave substantial portions of the surface of a disc installed in the storage and display element exposed, so that labeling, images, etc., printed on the surface of the disc exposed to view, which helps in the organization, browsing, and selection of particular discs in a storage and display device as herein disclosed.

In another aspect the invention provides a rotary disc storage and display device. The rotary storage and display device comprises a rotor; at least one disc storage and display element (preferably a plurality of any or all of the types described above) articulately mounted on the rotor and adapted for releasable engagement of a disc; and means for selectively rotating and positioning the rotor; whereby the disc may be stored, positioned, located, and selected in accordance with a preference of a user of the device. In preferred embodiments of these aspects of the invention the rotor is substantially cylindrical and comprises an outer surface having at least one annular mounting rail extending circumferentially around the surface, and the disc storage and display element comprises mounting segments each having at least one open-side aperture adapted to releasably engage the annular mounting rail. Optional additional components include index tabs adapted to engage the rotor and provide means for organizing and locating discs stored by the device, and protective covers. Preferred protective covers are hinged to provide convenient access and protection for the storage and display device.

According to another aspect of the invention, a disc filing and storage system may comprise a flexible envelope having an elongated strip of flat material along one edge thereof, and having a length and width sufficient to receive the disc to be stored and displayed therein. One longitudinal edge of the strip carries a pair of openings having predetermined shapes and spacing therebetween for attaching to a card index file mandrel (or rotor). The transparent or translucent envelope may be constructed of a flexible plastic with an opening along one side thereof This opening may be positioned on any of the four sides of the envelope as desired, and may preferably include a resealable closure so that the disc will be maintained securely therein whenever stored or displayed. The entire assembly may preferably be housed within a protective cover or housing which is hinged to open for access to the storage system.

Other objects and advantages of the present invention will be apparent upon reference to the accompanying drawings, which are exemplary.

BEST MODE OF CARRYING OUT THE INVENTION

Figure 1:
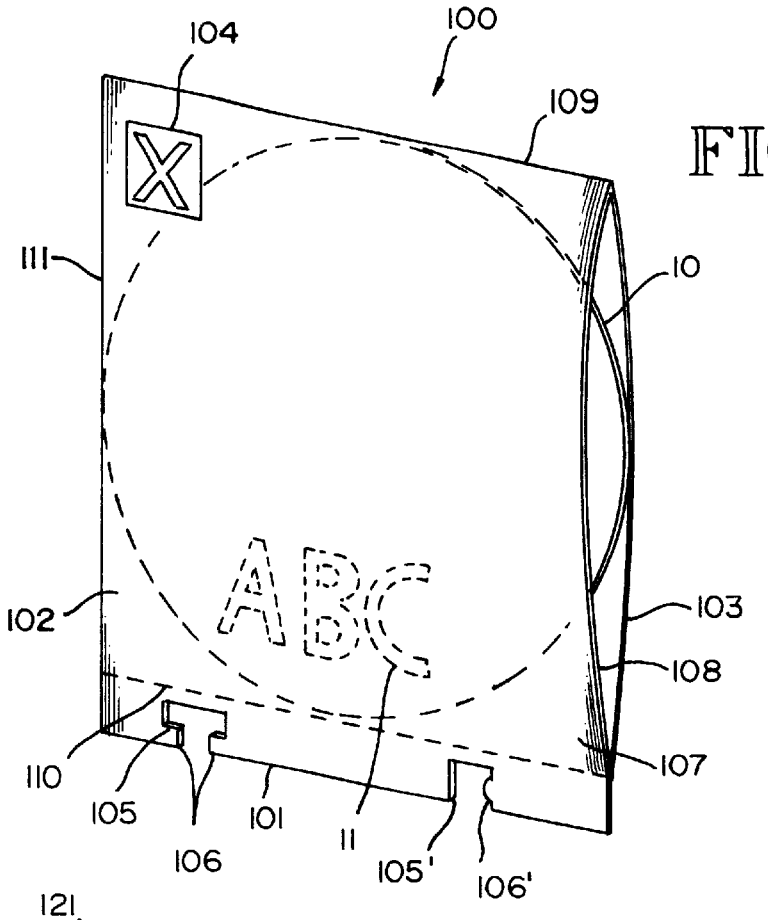
FIG. 1 is a perspective view of a preferred embodiment of a disc storage and display element according to the invention (disc installed).

For purposes of this disclosure, "disc" means any disc or diskette of a substantially flat circular shape. The term includes computer "floppy" discs (including the common 3.5" and 5.25" diameter floppy discs with rectangular protective covers and access doors) compact discs (herein "CD"'s), digital video display (DVD) discs and CD-read only memory (CD-ROM) discs, as well as audio, visual, and other so-called "compact" discs, and other information-carrying laser or magnetic discs.

Turning now to the drawings, the invention will be described in a series of preferred embodiments by reference to the numerals of the drawing figures wherein like numbers indicate like parts.

FIG. 1 is a perspective view of a preferred embodiment of a disc storage and display element according to the invention. Storage and display element 100 comprises mounting segment 101 and envelope 102, which consists of two face sheets 107 and 108 joined at edges 109, 110, and 111, but open at edge 103 so that disc 10 may be placed inside and retained by the envelope. Envelope 102 functions to retain the disc by providing support for the disc in all translational and rotational degrees of freedom except those through the opening in edge 103. In preferred embodiments disc 10 is primarily restrained from moving through the opening by friction between the disc and face sheets 107 and 108 (and/or any other items stored in the envelope, as for example a libretto or card related to the disc) and/or a protective flap (not shown) releasably installed over the opening and closed by hook and loop fasteners or other closing means. Mounting segment 101 is adapted to engage the rotor of a rotary display device such as those taught by this disclosure. In the preferred embodiment depicted in the Figure, mounting segment 101 comprises open-sided apertures 105 and 105' which with mounting segment 101 define, by their shapes, tabs 106 and 106' for engagement of a mounting rail on a rotary storage device according to the invention. Depending upon the shape of the mounting rail and the application to which the element is to be put, as herein elsewhere discussed, apertures 105 and 105' and tabs 106 and 106' may have any of a variety of shapes. The purpose of apertures 105 and 105' and tabs 106 and 106' is to allow display element 101 to be removably but securely installed on a rotor of a rotary display device; any aperture/tab configuration which will permit that function to be filled will serve. The selection of suitable configurations will be well within the scope of the skilled designer armed with the disclosure of the invention.

In some instances it has been found to be advantageous to locate the envelope opening at edge 109 of the storage and display element. In such embodiments a closure flap having an end fastened to one sheet of the envelope and directed back toward mounting segment 101 may be utilized so as to form a secure means to close the envelope whenever a disc is contained therein. Optionally, a hook and loop type fastener may be used to secure the flap in a closed position. The closure thus has sufficient rigidity and resiliency to provide secure retention of the disc therein, yet is easy to open and thereby facilitate removal of the disc.

Preferred embodiments of the storage and display element depicted in FIG. 1 are comprised of flexible plastic, particularly in the mounting segment and envelope portions. Such preferred embodiments (along with many others) may be made with integral mounting segments and envelope portions. For example, as will be appreciated by the artisan of ordinary skill, the envelope and mounting segment may conveniently and efficiently be fabricated from a single sheet of plastic by folding the sheet along upper edge 109 and bonding or joining along edges 111 and 110, and throughout mounting segment 101, into which may be cut apertures 105 and tabs 106. Edge 110 of the envelope adjacent to the mounting segment is shown in the figure as a dashed line because it may represent a joint between physical parts or a functional transition in integral parts. It is also convenient or efficient in some circumstances to form the mounting segment and envelope from different pieces, and to "sandwich" lower edge 110 of the envelope between the mounting segments. In such embodiments the envelope opening may be formed by the mounting segments themselves, and pass through lower edge 110 of the envelope instead of side 103 or the equivalent.

Preferred envelopes 102 like that shown in the Figure incorporate, in whole or part, transparent plastic such that one or both faces of the disc may be viewed, and in particular so that any writing or labeling 11 on the disc face may be read. Preferred envelopes 102 are further comprised of scratch-resistant plastics such as are well known in the art of plastics manufacturing, in order to reduce scratch damage to both the envelope itself and to any disc placed within it. Preferred storage and display elements are also adapted for the application of labels to the element itself, as for example label 104 applied to envelope 102 in the Figure. Envelopes 102 are preferably made by bonding or molding two flat sheets of suitable transparent plastics material, with an edge of the mounting segment 101 positioned therebetween. Heat sealing of compatible plastic materials may be used to bone the edge elements and envelope together, or adhesive, solvent or other joining means may be used. After the flat members have been molded together as described above, openings are formed in the bonded or molded longitudinal edge by punching or some other suitable process known in the art.

Among the particular advantages offered by disc storage and display elements according to this aspect of the invention are their relatively extreme light weight, superior protective qualities, and their remarkable compactness. Whereas, for example (and as previously mentioned), conventional CD-ROM boxes occupy approximately 15 times the space occupied by such discs themselves, a disc storage and display element according to this aspect of the invention may occupy no more than 15–50 percent more space than the disc alone, when fabricated of plastic materials as herein described. Thus at a conservative estimate the storage density for such discs may be increased tenfold, with no sacrifice in safety for the discs, and—particularly when coupled with the use of rotary storage and display devices as herein disclosed—improved sorting and retrieval capabilities.

Figure 2:
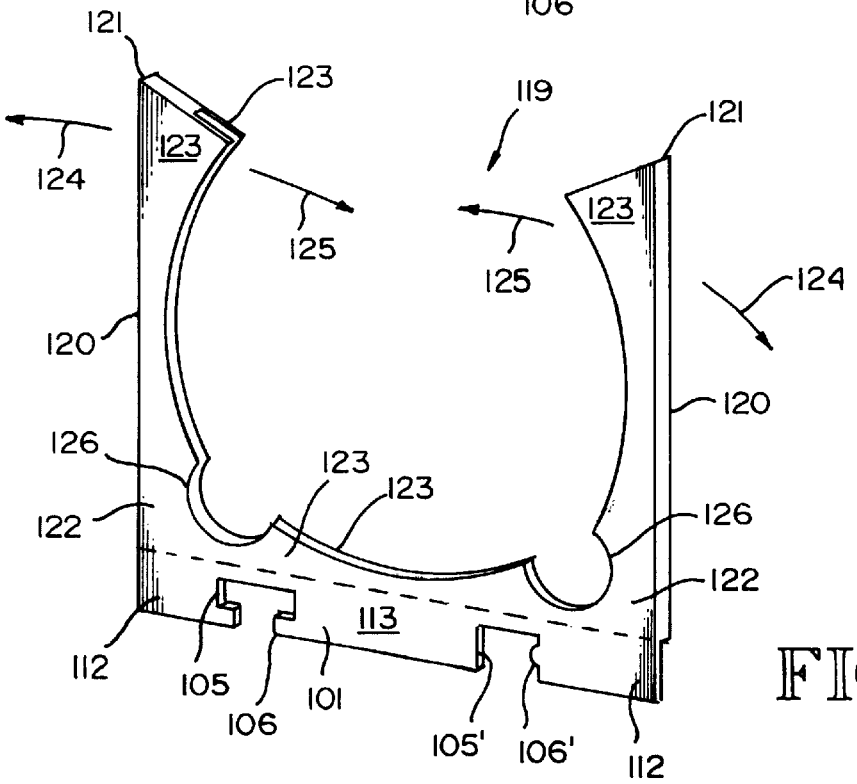
FIG. 2 is a perspective view of a preferred embodiment of an alternative disc storage and display element according to the invention (disc not installed).

FIG. 2 is a perspective view of a preferred embodiment of an alternative disc storage and display element according to the invention. Storage and display element 119 comprises mounting segment 101, which is adapted to engage a rotor of a rotary display structure, and disc support members 120, which are attached to the mounting segment and adapted to releasably engage a disc (not shown in FIG. 2), whereby the disc may be supported and stored by the element. In the embodiment shown disc support members 120 comprise first ends 121 and second ends 122, and depend from the mounting segment by the second ends. Moreover, disc support members 120 comprise lateral support members 123, which are adapted to receive and engage the edge of a substantially circular disc, so as to support the disc against transverse movement with respect to the element 119; and are adapted to circumferentially flexibly engage an edge of the disc at a location on the circumference of the disc located further distant from the mounting segment than the center point of the disc. Thus the disc support members are well adapted to apply to the disc, when the disc is subjected to a load such as that induced by gravity or an external contact, a reactive force having a component directed toward the mounting segment, and a force having a component transverse to a plane intersecting the mounting segment and the disc support members, such that the disc is retained in place by the storage and display element. Mounting segment 101 of the support and display element 119 further comprises open-sided apertures 105 and 105' and tabs 106 and 106' adapted to engage a mounting rail on the rotor of a storage and display device according to the invention.

Figures 3A, 3B, 3C:
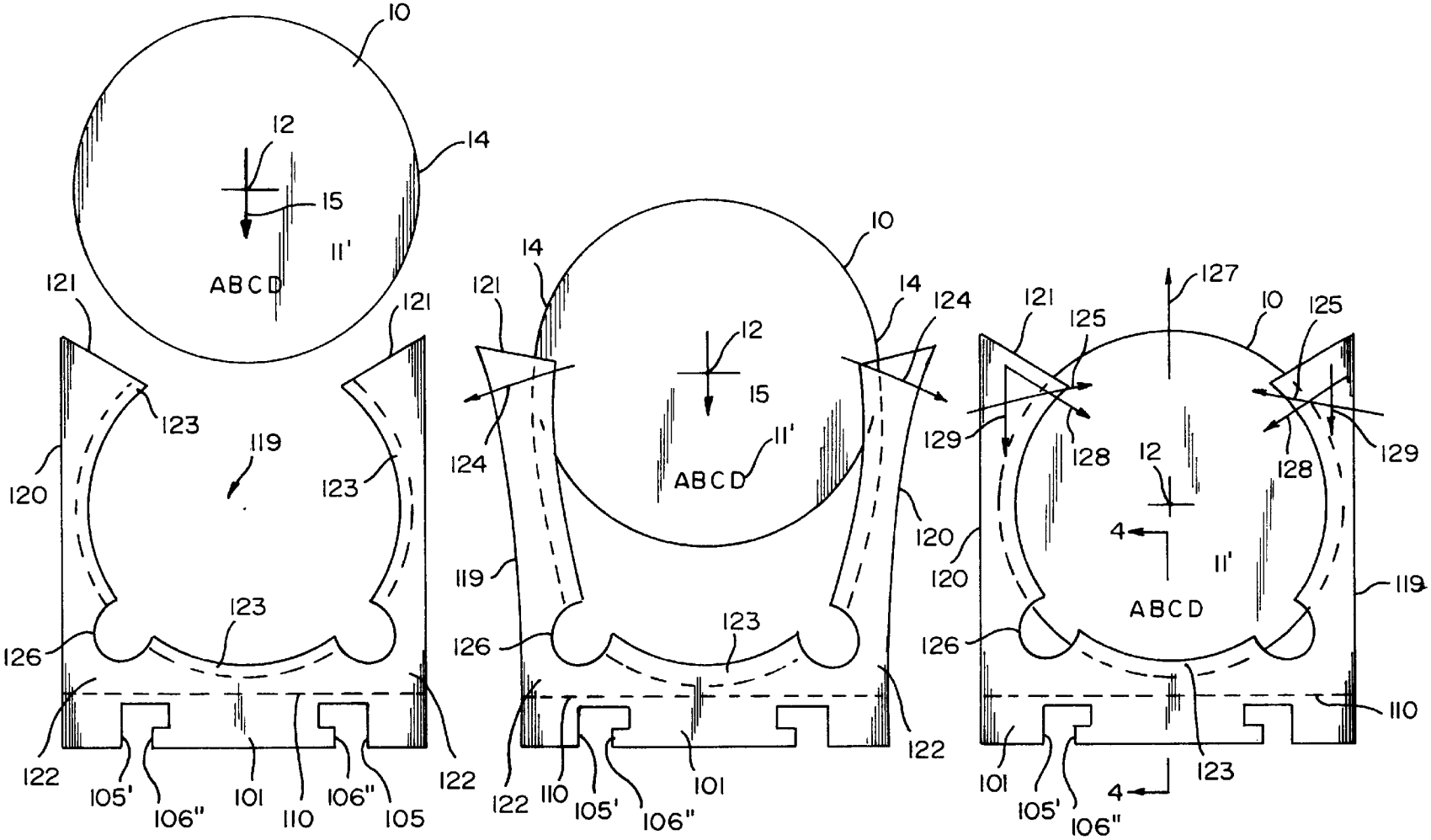
FIGS. 3*a*, 3*b*, and 3*c* comprise a schematic view of the installation of a disc in a preferred embodiment of a disc storage and display element according to the invention.

The function of this storage and display element aspect of the invention is depicted in FIGS. 3*a*, 3*b*, and 3*c*. FIGS. 3*a*, 3*b*, and 3*c* comprise a schematic view of the installation of a disc in a preferred embodiment of a disc storage and display element according to the invention. In FIG. 3*a* disc 10 is adjacent to but not in contact with storage and display element 119, ready for insertion into the element. By moving disc 10 downward (in the sense shown in the Figure) in the direction of arrow 15, disc 10 is brought into contact with first ends 121 of disc support members 120. Disc 10 is directed between lateral support elements here shown, as in FIG. 3*a*, in the form of channels longitudinally disposed along the support members. As disc 10 is pushed further into the element disc support members 120, being flexible, begin under the influence of disc edge 14 to flex or bend outward in the direction of arrows 124 shown in FIG. 3*b*. Flexure of the storage and display element occurs mainly in disc support members 120, at and above their second ends and in particular above optional cut-outs 126, which reduce the bending stiffness of the disc support members, particularly in the region of second ends 122. Additional flexure, however, can be expected (even encouraged) to occur in mounting segment 101. Although no mounting segment flexure is depicted in the Figures, the mechanisms of such flexure, the advantages to be gleaned from it, and methods for inducing and controlling it will be well understood by those of ordinary skill in the art of plastic structure design/manufacturing, once armed with the disclosure of this invention. As the disc is pushed down and the point of greatest width of the disc passes first ends 121, disc support members 120 flex back in the direction of arrows 125 (shown in FIG. 3*c*) to support and engage the disc, as by "embracing" the disc. As the disc nears full insertion, as best shown in FIG. 3*c*, the bottom of edge 14 proximate the mounting segment is engaged by optional additional lateral supports 123 in mounting segment 101. In the fully-inserted position Disc 10 is fully supported by storage and display element 119: if for example a force is applied to the disc in the direction of arrow 127 (as if the disc were being pulled out of the element by a user), contact by the disc support members against the edge of the disc results in the generation of reaction forces 128, which comprise components 129 opposed to force 127 and which serve to maintain the disc in position in the storage and display element.

Preferred embodiments of this aspect of the invention are made of plastic or of any other material having sufficient flexibility, durability, strength, and fatigue and corrosion resistance to accomplish the purpose under repeated insertions and removals of discs. The selection of appropriate materials and specific dimensions for this and other aspects of the invention will be well within the ability of the designer of ordinary skill.

Among the principal advantages of this aspect of the invention are sure, secure retention of discs in a relatively compact structure. Storage and display elements according to this aspect of the invention can easily provide safe, protected storage for discs in volumes of no more than 1.5 to 2 times the volume of the disk itself, thus reducing by at least seven fold the amount of space required for storage of discs, as compared to prior art devices as discussed above; this advantage is particularly well marked when such storage and display elements are used in conjunction with storage and display devices as disclosed herein. Moreover, as previously mentioned, preferred embodiments of this aspect of the invention leave at least the front face or surface of the disc exposed, so that any printing or labeling on the surface is exposed to the view of a user.

Figure 4:
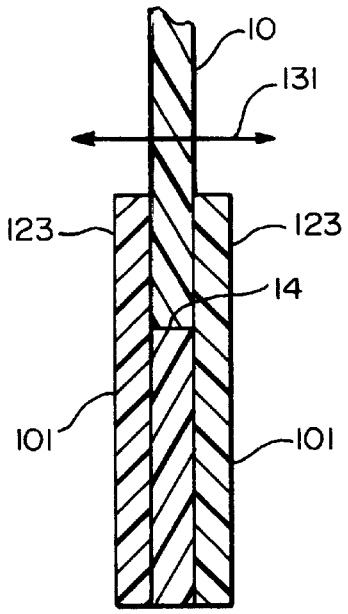
FIG. 4 is a partial cutaway view of a preferred embodiment of a disc storage and display element according to the invention, taken along view 4—4 in FIG. 3*c*.

FIG. 4 is a partial cutaway view of a preferred embodiment of a disc storage and display element according to the invention taken along view 4—4 in FIG. 3*c*. FIG. 4 illustrates the geometry of the lateral support members of the disc storage and display element depicted in FIG. 3. Disc 10 is disposed between lateral support members 123, which are used to form, together with spacer 130, support segment 101 for the storage and display element and which serve to counter transverse forces applied to the disc. A transverse force, for the purposes of this disclosure is a force comprising a component in either of the directions shown by arrows 131. Laminar construction of the storage and display element, as described, may be used very efficiently in fabricating storage and display elements according to the invention.

Figure 5:
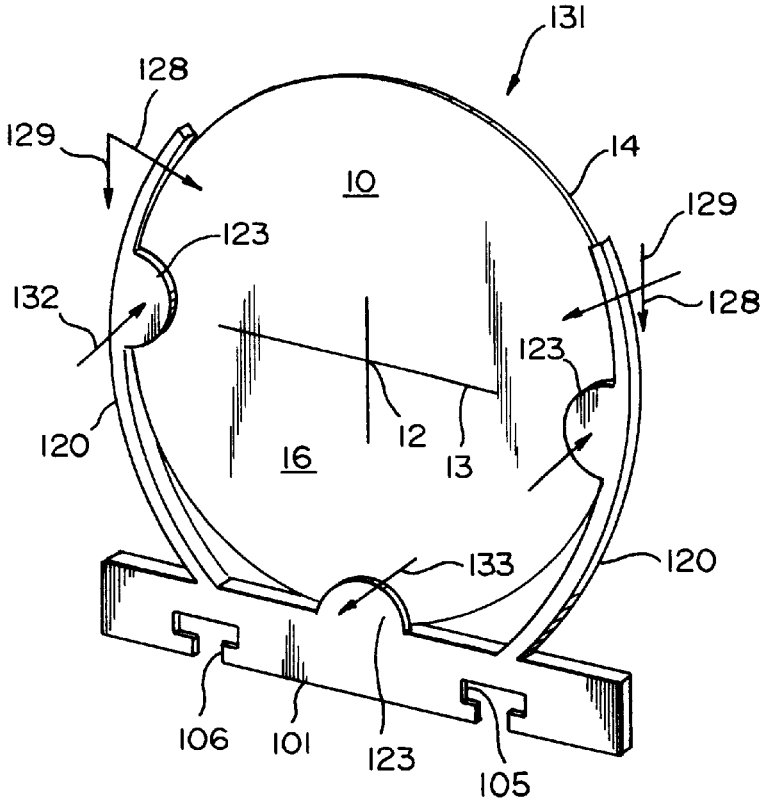
FIG. 5 is a perspective view of an alternative preferred embodiment of a disc storage and display element according to the invention.

The function of lateral support elements 123 is perhaps best illustrated in FIG. 5. FIG. 5 is a perspective view of an alternative preferred embodiment of a disc storage and display element according to the invention. Disc support members 120 depend from mounting segment 101 and comprise lateral support members 123. Lateral support members 123 and disc support members 120 engage the outer circumference and faces of disc 10, and hold the disc in place inside the element in essentially the same fashion as previously described. When disc 10 is subjected to transverse force 131, which acts normal to the plane described by face 16 of the disc, lateral support elements 123 attached to disc support members 120 develop reactive forces in the direction of arrows 132, as shown, while lateral support members 123 attached to mounting segment 101 develop reactive force 133 in the sense shown. Thus disc 10 is retained within the storage and display device.

Figure 6:
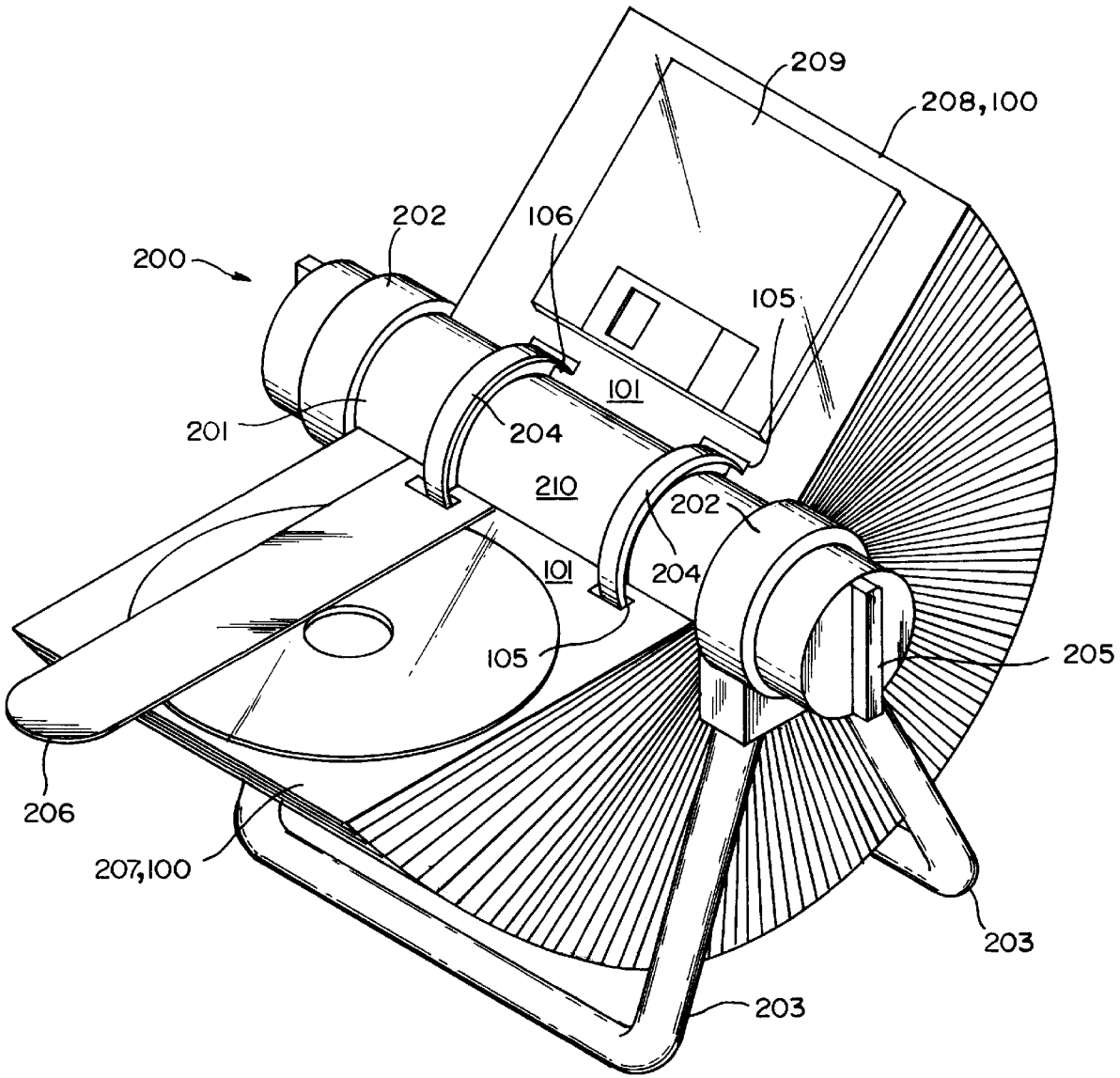
FIG. 6 is a perspective view of a disc storage and display device according to the invention.

FIG. 6 is a perspective view of a disc storage and display device according to the invention. Disc storage and display device 200 comprises rotor 201, a plurality of disc storage and display elements 100, 119 (not clearly shown in this Figure), 207, and 208 articulately mounted on the rotor and adapted for releasable engagement of discs, and means 205 for selectively rotating and positioning the rotor. By installation of the disc storage and display elements upon the rotor, placement of discs within the elements, and rotation of the rotor and manipulation of the storage and display elements, a large number of discs may be stored, organized, located, selected, and removed in accordance with a preference of the user, the number of discs accommodated being limited only by the specific geometry of the system used. In this regard it is noted that the sizing of the various elements described will not trouble the storage and display device designer once he or she has been armed with the disclosure of this invention. Storage and display device 200 further comprises supports 203, to which rotor 201 is attached by means of journals 202, and index tab 206, which permits rapid identification of predetermined locations on the rotor, and thus assists sorting and further organization of discs stored in the device. As previously mentioned, the use of labels attached to the storage and display elements, or to the discs themselves, can greatly help in organizing discs as well. As an example, music CD-ROM discs might be sorted by category—e.g. classical, country, jazz, and rock—and subsorted alphabetically, as by title, composer, or performer, placed in a storage and display element, and attached to the storage and display device, with index tabs inserted between categories.

Figure 7:
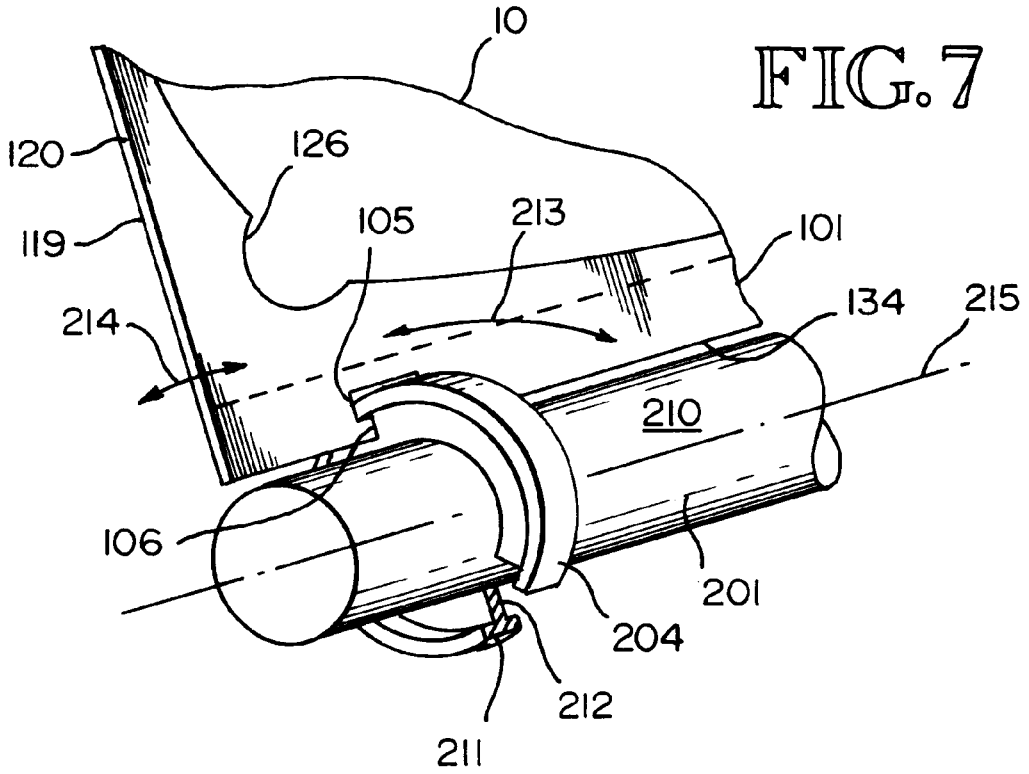
FIG. 7 is a schematic partial perspective view of a preferred embodiment of the attachment of disc storage and display elements to a rotor of a disc storage and display device according to the invention.

As shown in FIG. 6, a preferred embodiment of the storage and display element-to-rotor aspect of the invention comprises a substantially cylindrical rotor 200 having outer surface 210 upon which are disposed at least one and preferably two annular mounting rails 204 extending circumferentially about the outer surface, the annular mounting rails being adapted for releasable engagement by open-sided apertures 105 provided on storage and display elements such as those disclosed herein. A preferred embodiment of one such annular rail system is depicted in FIG. 7. Annular mounting ring 204 is configured as a T-section rail comprising cap or flange 211 and web 212 (in the Figure the rail is shown partially in section, for illustrative purposes; preferred rails according to the invention are continuous about the circumference of the rotor). Disc 10 is in place in storage and display element 119, which is attached to rotor 201 by means of open-sided aperture 105 and its tab 106. Aperture 105 and tab 106 flexibly engage the rail to permit articulated movement of storage and display 119 device about rotor 201 on rail 204. By "articulated movement" is meant both translational movement about the rotor (in other words, movement about the rotor with the storage and display element continuously normal to central longitudinal axis 215 of the rotor) in the direction of arrows 213, and/or rotated in place about edge 134 of the storage and display element in the direction of arrows 214. It is the ability of the storage and display element to be both "translated" and "rotated" in such fashion which allows discs retained in storage and display elements according to the invention to be reviewed by a user of the storage and display device with great convenience.

The rotor of the storage and display device of the invention may be manipulated in any of a large number of ways. For example, the device depicted in FIG. 6 is provided with handles 205 at the either end of the rotor for manual rotation of the rotor and the storage and display elements on it. Such rotation could also be accomplished by means of electric or other motors, with or without automatic searching and locating means, as will occur to those skilled in the art.

The use of a storage and display device according to the invention provides many significant advantages over conventional disc storage means. For example, space requirements for searchable storage of discs is greatly reduced: the use of CD- or DVD-sized envelopes on a 1.5 inch diameter rotor as disclosed herein has been found to allow safe, secure, searchable storage of more than 100 CD or DVD discs (that is, more than 100 discs may be stored without risk of scratching or other damage under normal usage) in a space which formerly could have been occupied by only a few dozen discs in conventional CD and DVD cases of the type discussed above. The rotary storage and display device according to the invention also allows discs to be very easily organized, searched, retrieved, and even moved en masse from spot to spot with very little difficulty. Anyone familiar with conventional CD and DVD cases will appreciate the difficulty of sorting and organizing a stack of several dozen cased discs, keeping them neat and sorted in their several stacks, and retrieving a desired disc, or even of browsing for a choice—and especially of doing so without sowing chaos and disorder among the stacks of slick, ungainly cases. And until the advent of the invention described herein, the alternative was a bulky, expensive, seldom attractive, built-for-the-purpose storage case.

Figure 8:
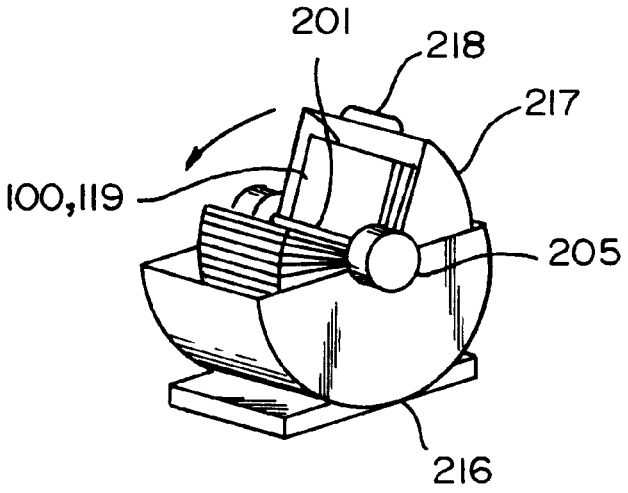
FIG. 8 is a perspective view of a preferred embodiment of a disc storage and display device according to the invention, comprising a cover.

Storage and display devices according to the invention may be supported in any number of ways which will occur to those skilled in the art, once they have been armed with the disclosure herein. For example, simple legs such as legs 203 (shown in FIG. 6) may be attached to the rotor (as by journals 202 shown in that Figure), or by mounting the rotor and storage and display elements in a case, as shown in FIG. 8. In FIG. 8 case 216 is attached to rotor 201. The case is also provided with optional cover 217, which is rotatably mounted on the rotor and is moved or adjusted by means of handle 218. Covers may also be mounted in a variety of other ways which will occur to designers familiar with the art. For example, a cover might be hinged at the back edge of the case. Preferred materials for construction of cases and covers according to this aspect of the invention include durable, high-impact plastics; for covers, transparent plastics are particularly preferred.

While the storage and display elements and devices of the invention filing attachment of the present invention are primarily intended for the storage and display of CD, CD-ROM, and DVD discs or floppy diskettes, the structures may be made in other sizes so as to store and display other objects, as for example tutorial or informative pamphlets or cards associated with the discs, such as those that commonly accompany commercially sold CD music discs. Also, while in the usual rotary file the cards are mounted substantially horizontally, the storage and display devices of this invention could also be used for mounting in a rotary file positioned with its axis in a vertical position. Paper cards or other media upon which information about the discs contained in envelopes 100 and storage and display elements 109 may be interleaved into the rotary file structure so that information on the discs in adjacent envelopes may be readily ascertained. As previously indicated, protective covers may be used to great advantage to enclose the storage structure, preferably having an articulated or hinged access.

Thus, it can be seen that the present invention has disclosed a storage and display means for computer discs and diskettes which enables these objects to be readily stored and displayed in a convenient rotary file means which securely but removably positions the objects in a convenient mode to be reviewed and chosen for use.

It will be understood that this invention is susceptible to modification in order to adapt it to different usages and conditions, and accordingly, it is desired to comprehend such modifications within this invention as may fall within the scope of the appended claims.

What is claimed is:

1. A disc storage and display element, the element comprising:

at least one mounting segment, the mounting segment comprising a pair of open-sided apertures adapted for the removable reception and engagement of a rail on a rotor of a rotary display structure; and at least two disc support members, the disc support members comprising first and second ends and attached at said second ends to the mounting segment;

at least one of the disc support members comprising lateral support members adapted to receive at least one edge of a substantially circular disc, said lateral support members selected from the group comprising longitudinally disposed channels or support tabs; and at least one of the disc support members is adapted to circumferentially flexibly engage an edge of the disc at a location on a circumference of the disc further distant from the mounting segment than a center point of the disc;

whereby the storage and display element is adapted to supply to the disc both circumferential and transverse support and the disc is releasably retained by the storage and display element.

2. A disc storage and display element, the element comprising:

at least one mounting segment adapted to engage a rotor of a rotary display structure; and at least two disc support members, the disc support members comprising first and second ends and attached at said second ends to the mounting segment, the element adapted to flexibly receive and engage the disc, at least one of the disc support members comprising lateral support members adapted to receive at least one edge of a substantially circular disc, said lateral support members selected from the group comprising longitudinally disposed channels or support tabs.

3. A disc storage and display device, the device comprising:

a rotor;

at least one disc storage and display element articulately mounted on the rotor and adapted for releasable engagement of a disc, the storage and display element comprising a mounting segment and at least two disc support members, the disc support members comprising first and second ends and attached at said second ends to the mounting segment, at least one of the disc support members comprising lateral support members adapted to receive at least one edge of a substantially circular disc, said lateral support members selected from the group comprising longitudinally disposed channels or support tabs; and means for selectively rotating and positioning the rotor;

whereby the disc may be stored, positioned, located, and selected in accordance with a preference of a user.

4. The device of claim 3, wherein the rotor is substantially cylindrical and comprises an outer surface and having at least one annular mounting rail extending circumferentially about the surface, and the disc storage and display element comprises a mounting segment having at least one open-side aperture adapted to releasably engage the annular mounting rail.

5. The device of claim 3, further comprising at least one index tab adapted to engage the rotor and provide means for organizing and locating discs stored by the device.

6. The device of claim 3, further comprising a protective cover.

7. The device of claim 6, wherein the protective cover is hinged.

* * * * *

UNITED STATES PATENT AND TRADEMARK OFFICE

CERTIFICATE OF CORRECTION

PATENT NO. : 6,119,381

DATED : September 19, 2000

INVENTOR(S) : Adam Grocholski

It is certified that error appears in the above-identified patent and that said Letters Patent are hereby corrected as shown below:

Column 6, lines 55-56, after "than", delete "the center point of the disc" and insert therefor "center point 12 of the disc".
Claim 1, column 10, line 46, delete "at least".
Claim 1, column 10, line 49, delete "at least one of".
Claim 1, column 10, line 52, delete "comprising", and insert therefor "consisting of"
Claim 1, column 10, line 53, delete "or", and insert therefor "and".
Claim 1, column 10, line 54, delete "at least one of", and delete "is".
Claim 1, column 10, line 55, after "the ", insert "substantially circular".
Claim 1, column 10, line 61, after "the", (first occurrence), insert "substantially circular".
Claim 2, column 10, line 65, delete "t least one".
Claim 2, column 11, line 1, delete "at least".
Claim 2, column 11, lines 3-4, delete ", the element adapted to flexibly receive and engage the disc".
Claim 2, column 11, line 5, delete "at least one of".
Claim 2, column 11, line 8, delete "comprising", and insert therefor "consisting of".
Claim 2, column 11, line 9, delete "or" and insert therefor "and".
Claim 2, column 11, line 9, after "tabs", insert "; and the disc support members adapted to circumferentially flexibly engage an edge of the substantially circular disc at a location on a circumference of the disc further distant from the mounting segment than a center point of the disc;

whereby the storage and display element is adapted to supply to the disc both circumferential and transverse support and the substantially circular disc is releasably retained by the storage and display element".
Claim 3, column 11, line 15, after "a", insert "substantially circular".
Claim 3, column 11, line 16, after "and", delete "at least".
Claim 3, column 11, line 19, after "segment,", delete "at least one of".
Claim 3, column 11, line 21, delete "a", and insert therefor "the".
Claim 3, column 12, line 1, delete "comprising", and insert therefor "consisting of".

UNITED STATES PATENT AND TRADEMARK OFFICE

CERTIFICATE OF CORRECTION

PATENT NO. : 6,119,381

DATED : September 19, 2000

INVENTOR(S) : Adam Grocholski

It is certified that error appears in the above-identified patent and that said Letters Patent are hereby corrected as shown below:

Claim 3, column 12, line 2, delete "or" and insert therefor "and".

Claim 3, column 12, line 2, after "tabs;", insert "the disc support members being adapted to circumferentially flexibly engage an edge of the substantially circular disc at a location on a circumference of the disc further distant from the mounting segment than a center point of the disc;".

Claim 3, column 12, line 4, after "the", insert "substantially circular".

Claim 4, column 12, line 7, second occurrence, delete "and".

Claim 4, column 12, lines 9-10, delete "the disc storage and display element comprises a".

Claim 4, column 12, line 10, before "mounting", insert "said".

Claim 4, column 12, line 10, delete "having" and insert therefor "includes".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*